US005127771A

United States Patent [19]

Wind

[11] Patent Number: 5,127,771

[45] Date of Patent: Jul. 7, 1992

[54] NARROW OR SLOTTED WALL WHICH IS INTRODUCED INTO A SUBSTRATUM AND SEALING WALL COMPOSITION CONTAINED THEREIN

[75] Inventor: Heinz Wind, Kronberg, Fed. Rep. of Germany

[73] Assignee: Philipp Holzmann Aktiengsellschaft, Frankfurt am Main, Fed. Rep. of Germany

[21] Appl. No.: 613,225

[22] Filed: Nov. 9, 1990

[51] Int. Cl.[5] ..... E02D 29/00; E02D 31/02

[52] U.S. Cl. ..... 405/267; 405/258; 405/266; 340/604

[58] Field of Search ..... 405/267, 128, 129, 258, 405/263; 324/559; 73/49.2 T; 340/603, 604, 602, 605

[56] References Cited

U.S. PATENT DOCUMENTS

| | | | |
|---|---|---|---|
| 3,382,493 | 5/1968 | Lopey et al. | 340/604 X |
| 3,824,460 | 7/1974 | Gustafson | 340/604 X |
| 4,404,516 | 9/1983 | Johnson | 324/557 |
| 4,538,141 | 8/1985 | Feldman | 340/604 |
| 4,543,016 | 9/1985 | Tallard | 405/267 |
| 4,598,277 | 7/1986 | Feldman | 340/604 |
| 4,671,705 | 6/1987 | Nussbaumer et al. | 405/267 |
| 4,844,662 | 7/1989 | Kallinich et al. | 405/267 X |
| 4,845,472 | 7/1989 | Gordon et al. | 340/604 X |

FOREIGN PATENT DOCUMENTS

| | | |
|---|---|---|
| 0190410 | 12/1986 | European Pat. Off. . |
| 0298283 | 11/1989 | European Pat. Off. . |
| 971984 | 6/1959 | Fed. Rep. of Germany . |

*Primary Examiner*—Dennis L. Taylor

*Attorney, Agent, or Firm*—Scully, Scott, Murphy & Presser

[57] ABSTRACT

A narrow wall or slotted wall which is introduced into a geological substratum or foundation, including a sealing wall composition contained therein, and at least one sealing wall plate which, for example, is constituted of glass. The sealing wall plate which is fixed in the sealing wall composition or, the sealing wall plates, possesses or possess devices for the detection and recognition of leakages. These devices can be constituted from hollow profile members which are connected with the sealing wall plates; in essence, can be integrated therein.

7 Claims, 3 Drawing Sheets

NARROW OR SLOTTED WALL WHICH IS INTRODUCED INTO A SUBSTRATUM AND SEALING WALL COMPOSITION CONTAINED THEREIN

BACKGROUND OF THE INVENTION

1. Field of the Invention

The present invention relates to a narrow wall or slotted wall which is introduced into a geological substratum or foundation, including a sealing wall composition contained therein, and at least one sealing wall plate which, for example, is constituted of glass.

For the protection of the ground water from being polluted with contaminated waters seeping from a refuse or waste depository site, such as landfill or the like, the refuse or waste sites are surrounded with sealing walls.

In order to be able to monitor the sealing function of the sealing wall composition with regard to deformations or shifts in the soil and against chemical corrosions over lengthy periods of time, it is necessary to provide testing or instrumentation systems. This is especially importantly applicable when the sealing walls are constituted from only sealing wall compositions, even when these possess properties of a high degree of impermeability. It is impossible to preclude encountering the presence of fissures or cracks at various locations, into which there can unnoticedly migrate noxious or toxic materials, as well as in the wall itself.

2. Discussion of the Prior Art

It is known that by means of control well points or, in essence, watermark gauges, it is possible that on both sides of the sealing wall there can be tested or sampled the geological substratum conditions by means of physical probes and instrumentation systems. However, it is not possible to preclude that these well points or, in essence, respectively watermark gauges, will be subject to failure or malfunctions over lengthier periods of time because of various reasons. As a consequence thereof, it is absolutely necessary to position the devices for effecting the control measurements into the sealing wall plates themselves. This is also applicable for the encapsulation of presently existing, waste depots or landfills, wherein there is no longer any need to count on deformations or distortions of the sealing wall composition or, in essence, plate.

From the disclosure of European Patent 0298 283 A1 there has become known a structure consisting of a vertical slotted wall and a sealing wall arranged therein, which structure is inserted into a geological substratum, wherein the slotted wall is filled with a composition for forming the slotted wall and the sealing wall is installed in the slotted wall composition. In view of this construction, the invention in the European patent contemplates that the sealing wall is assembled from glass plates which, with the interposition of spacer retainers, are arranged with distancing interspaces whereby also the distancing interspaces are filled with the slotted wall composition.

The sealing along the joints of the individual glass plates can be undertaken in that the individual glass plates of the multi-plate glass units are pushed into contact against each other at the vertical joints, with the interposition of a sealing medium consisting of either rubber or a plastic material, and the thereby formed hollow space at the joints is filled with a bituminous casting composition. The individual glass plates are further positioned on each other along the horizontal joints with the interposition of a sealing web or strip constituted from rubber or from a plastic material, and which strip possess the width of the multi-plate glass units.

This sealing arrangement is extremely complicated in its assembly and introduction thereof into the joints of the installed glass plates, and nevertheless, its sealing effectiveness is not always adequate, especially not at the intersecting locations for the joints.

Also in this instance is it, as a consequence, necessary to be able to determine possible non-sealed or leakage conditions and to display this fact in order to comply within a requisite period of time with precautions or regulations against any penetration of toxic materials into the geological substratum or subsoil.

SUMMARY OF THE INVENTION

Accordingly, it is an object of the present invention to contemplate the provision of a wall of the above-mentioned type in which, through the utilization of simple but nevertheless dependable means, it is possible to effectuate a reliable testing and monitoring of the walls with regard to perviousness.

The inventive object consists of in that the sealing wall plate which is fixed in the sealing wall composition or, the sealing wall plates, possesses or possess devices for the detection and recognition of leakages.

These devices can be constituted from hollow profile members which are connected with the sealing wall plates; in essence, can be integrated therein. The devices may be vertically arranged or inclined in the longitudinal direction of the sealing wall plate in order to be able to determine fissures or cracks extending in all directions; for instance, such as vertically extending fissures. By means of these hollow profile members, it is possible to withdraw gas and liquid samples for their chemical and physical analysis.

These devices can also consist of electrical conductors within a corrosion-protected arrangement which are installed in or on the sealing wall plates, which vary in their electrical properties in the presence of a crack or break in the sealing wall plate, and which is reported through suitable instrumentation apparatus or trouble indicators.

The hollow profile members and the electrical conductors can also be provided in the shape of a combined or common unit.

BRIEF DESCRIPTION OF THE DRAWINGS

Further embodiments and features of the invention may now be more readily ascertained from the following detailed description, taken in conjunction with the accompanying drawings; in which.

DETAILED DESCRIPTION

Figure 1:
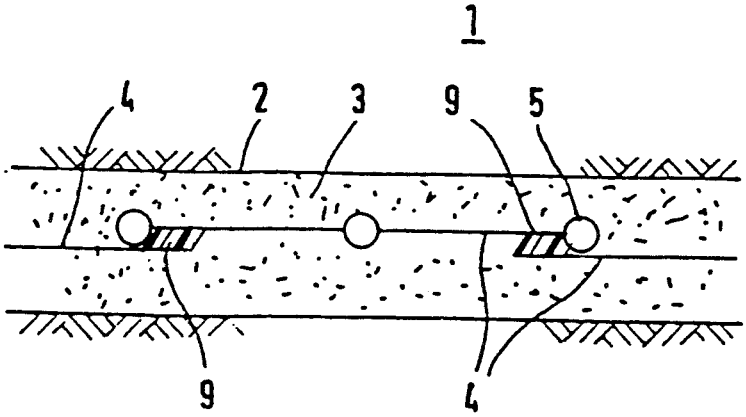
FIG. 1 illustrates a first exemplary embodiment of a narrow or slotted wall shown in a horizontal section.

Pursuant to FIG. 1, there is shown an arrangement of three sealing wall plates 4, of which the middle wall plate possesses three hollow profile members 5 which are integrated into the sealing wall plate 4. The entire arrangement is located within a slotted wall 2 which is inserted into the geological substratum or ground 1, and which is filled with a sealing wall composition 3. The sealing of the sealing wall plates 4 relative to each other is carried out through the employment a sealing composition consisting of a toxic material-resistant glass with a similarly toxic material-resistant binder medium; overall identified by reference numeral 9.

Figure 2:
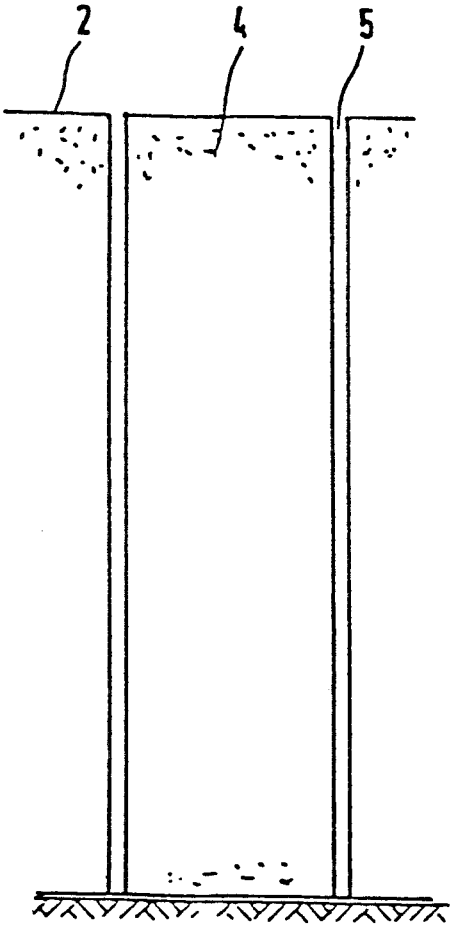
FIG. 2 illustrates the embodiment of FIG. 1 shown in a vertical section.
Figure 3:
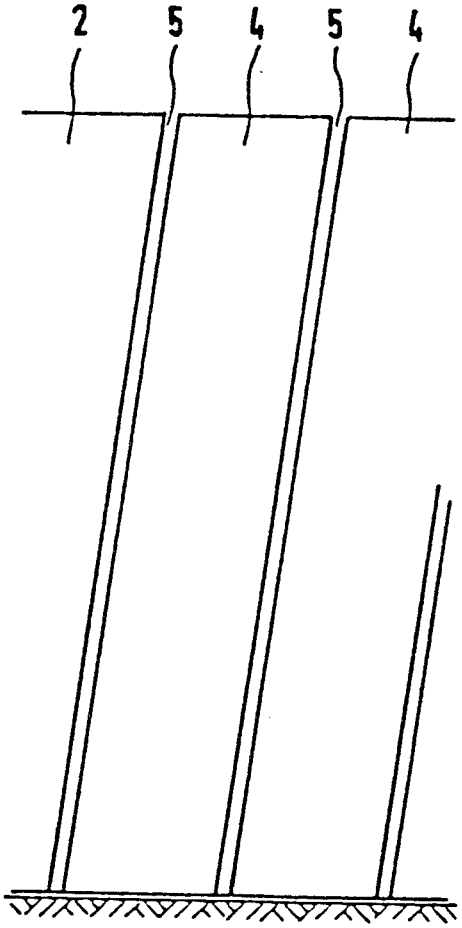
FIG. 3 illustrates a construction which is somewhat modified with respect to that of FIG. 2.
Figure 4:
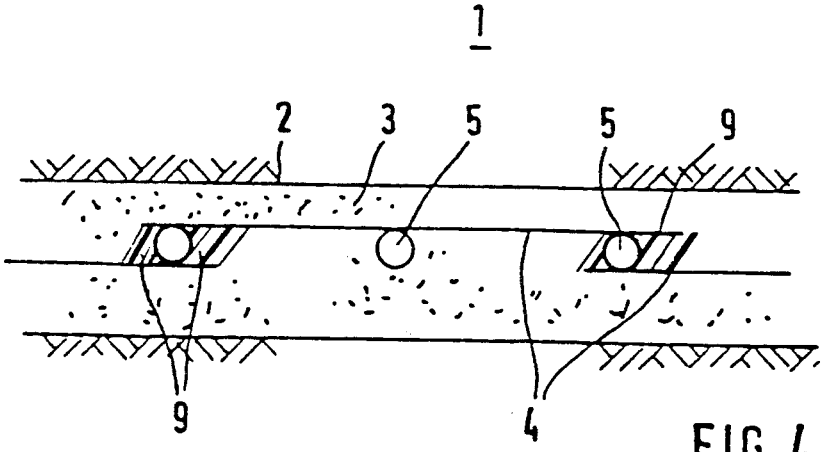
FIG. 4 illustrates a second embodiment in a horizontal section.

From FIG. 2 of the drawings there can be ascertained that the hollow profile members 5 can extend vertically, pursuant to FIG. 3 these are located to extend inclined or obliquely, in order to be able to detect not only horizontally but also vertically or obliquely extending fissures or cracks and the like. In FIG. 4 there can be ascertained that the hollow profile members 5 may be applied to one of the sealing wall plates 4, and at their ends there may be effectuated the sealing 9.

Figure 5:
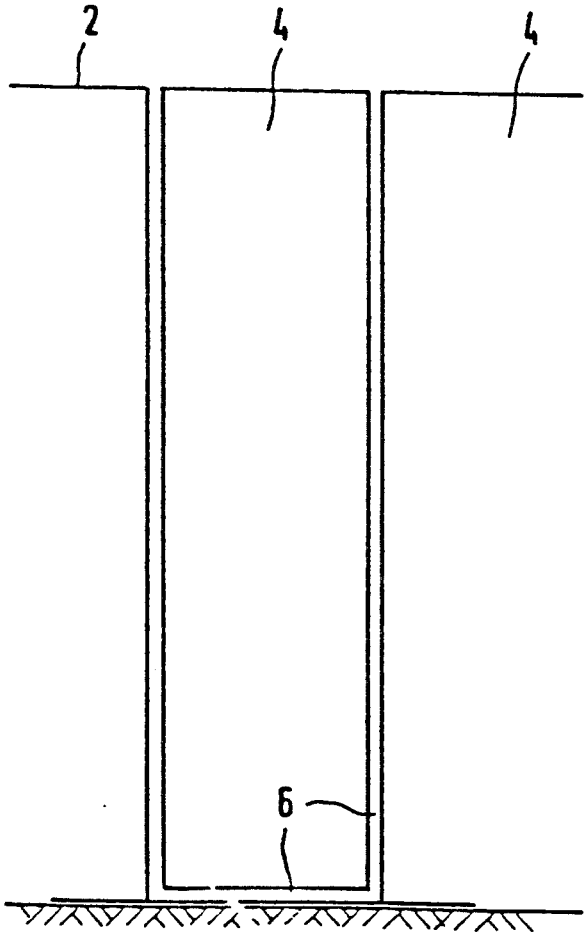
FIG. 5 illustrates the embodiment of FIG. 4 shown in a vertical section.

The hollow profile member 6 pursuant to the embodiment of FIG. 5 are interconnected at their lower ends, and are thereby accessible at both ends.

Figure 6:
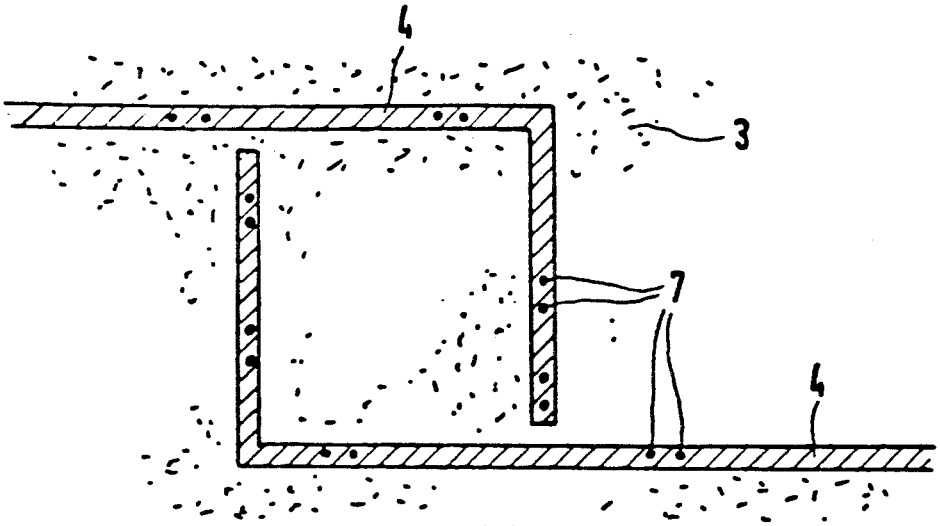
FIG. 6 illustrates a third embodiment shown in a horizontal section.

Embedded in the sealing wall plates 4 as shown in FIG. 6 are electrical conductors 7 so as to be protected against corrosion.

Figure 7:
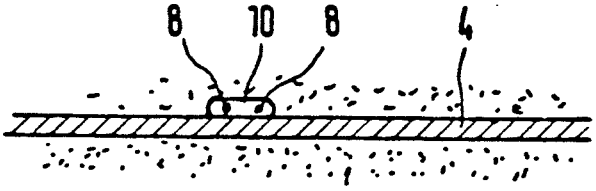
FIG. 7 illustrates a fourth embodiment shown in a horizontal section.

This foregoing construction is modified in accordance with FIG. 7, in that the electrical conductors 8 equipped with a protective casing 10 against corrosion are applied to the sealing wall plate 4.

What is claimed is:

1. In a narrow wall or slotted wall which is introduced into a substratum, including a sealing wall composition contained in said wall, and at least one sealing wall plate which is constituted of glass; the improvement comprising means for the detection of leakages in and the impermeability of said at least one sealing wall plate which is installed in the sealing wall composition, said means for the detection of leakages including hollow profile members which are applied to said at least one sealing wall plate; and a toxic material-resistant sealing composition for sealing at least some of said hollow profile members to said at least one sealing wall plate.

2. Wall as claimed in claim 1, comprising a plurality of said sealing wall plates, said sealing wall plates being arranged laterally offset and overlapping relative to each other; said sealing composition comprising means for sealing said sealing wall plates in the overlapping regions; and at least one said hollow profile member being inserted into said sealing means.

3. Wall as claimed in claim 1 or 2, wherein said hollow profile members extend at vertical or oblique orientations between upper and lower ends of said at least one sealing wall plate depending into the substratum.

4. Wall as claimed in claim 1 or 2, wherein said hollow profile members each have openings in the lower ends thereof, the lower openings of at least two said hollow profile members being interconnected.

5. In a narrow wall or slotted wall which is introduced into a substratum, including a sealing wall composition contained in said wall, and at least one sealing wall plate which is constituted of glass; the improvement comprising means for the detection of leakages on said at least one sealing wall plate, said plate being embedded in said sealing wall composition, said means for the detection of leakages including electrical conductors which are embedded so as to be protected against corrosion in said at least one glass sealing wall plate.

6. In a narrow wall or slotted wall which is introduced into a substratum, including a sealing wall composition contained in said wall, and at least one sealing wall plate which is constituted of glass; the improvement comprising means for the detection of leakages on said at least on sealing wall plate, said at least one sealing wall plate being embedded in said sealing wall composition, said means for the detection of leakages including electrical conductors applied onto said at least one glass sealing wall plate; and a corrosion-protective casing encompassing said electrical conductors.

7. Wall as claimed in claim 1 or 5 or 6, wherein said means for detection of leakages includes a combination of hollow profile members and electrical conductors.

* * * * *